US006811463B2

(12) United States Patent
Martz

(10) Patent No.: US 6,811,463 B2
(45) Date of Patent: Nov. 2, 2004

(54) AIR FILLED BRASSIERE

(76) Inventor: Christine Martz, 1128 Ruth Pl., North Bellmore, NY (US) 11710

( * ) Notice: Subject to any disclaimer, the term of this patent is extended or adjusted under 35 U.S.C. 154(b) by 62 days.

(21) Appl. No.: 10/174,870

(22) Filed: Jun. 21, 2002

(65) Prior Publication Data

US 2003/0236053 A1 Dec. 25, 2003

(51) Int. Cl.[7] ..... A41C 3/00
(52) U.S. Cl. ..... 450/57; 450/38; 2/267
(58) Field of Search ..... 450/1, 38, 39, 450/41, 46, 47, 49, 51, 52, 54–57, 81, 86, 88, 89; 2/2.5, 44, 45, 92, 267, 463, 455, 459–465; 623/7, 8

(56) References Cited

U.S. PATENT DOCUMENTS 2,516,129 A * 7/1950 Leo et al. ..... 450/38
5,022,887 A * 6/1991 Lawson ..... 450/54
5,034,998 A * 7/1991 Kolsky ..... 2/267
5,098,330 A * 3/1992 Greenberg ..... 450/55
5,274,846 A * 1/1994 Kolsky ..... 2/267
5,522,892 A * 6/1996 Lin ..... 450/57
5,769,688 A * 6/1998 Holliday ..... 450/57
6,083,080 A * 7/2000 Lawson et al. ..... 450/39
6,110,005 A * 8/2000 Stephenson et al. ..... 450/39
6,131,196 A * 10/2000 Vallion ..... 2/267
6,302,760 B1 * 10/2001 Dai ..... 450/38

* cited by examiner

*Primary Examiner*—Gloria M. Hale
(74) *Attorney, Agent, or Firm*—Alfred M. Walker

(57) ABSTRACT

An impact resistant woman's brassiere includes two fabric breast cups, each having pockets attached to a plurality of straps to secure the brassiere to a person's torso with a plurality of one or more removable shock absorbing removably insertable pads of high tensile strength polymer material having shape memory along with a plurality of disbursed air-filled bladders. The insert pads include a scattered plurality of vent holes, with fasteners attached to the fabric breast cups in order to anchor the pads within the pockets. Optionally, a pair of underwires are secured onto the lower portion of the breast cup. The material used for the pads is typically urethane. In addition, two or more pads may be inserted into each breast cup to enhance protection and simulate a greater bust size.

31 Claims, 5 Drawing Sheets

AIR FILLED BRASSIERE

FIELD OF THE INVENTION

The present invention relates to impact resistant and size enhancing brassieres.

BACKGROUND OF THE INVENTION

The prior art reveals a long progression of devices used for female figure enhancement by enlargement of the appearance of the breast area. These have included liquid and gel filled brassiere inserts, inflatable air-filled brassieres, and a wide variety of other padding variations.

Some of the designs permit adjustment of the amount of enhancement as by variations in the degree of inflation; however, this requires the use of an air pump as part of the system. The gel filled insert pads are of a single size and must be exchanged for ones of a different size to change the level of enhancement. Liquid or air-filled bladders can be a problem as they have difficulty maintaining a desirable shape when compressed by elements of outer garments or when they are inadvertently impacted.

While air-filled enhancement devices have a weight advantage over liquid or gel filled devices, both types are air impermeable and therefore tend to impede the evaporation of sweat that might therefore accumulate in hot environments or during vigorous activities. Some of the enhancement systems are also quite expensive.

Furthermore, a basic packaging material includes a "bubble wrap" configuration, such as collar polyethylene, which is less impact resistant and has an annoying crinkling noise.

Among related patents include U.S. Pat. No. 146,805 of Cox, which describes a brassiere with air-filled pockets.

In addition, U.S. Pat. No. 2,697,229 of Krueger discloses an air-filled brassiere with pockets for cup inserts which are filled with air through a tube.

U.S. Pat. No. 5,140,721 of Kauffeld discloses a diver's thermal insulating underwear with gas-holding bubbles.

U.S. Pat. No. 5,274,846 of Kolsky describes a cushion or pad for body parts, wherein an air or fluid-filled cellular structure is used.

U.S. Pat. No. 5,769,688 of Holliday describes a foam-filled sports brassiere.

U.S. Pat. No. 6,032,299 of Welsh discloses a horse jockey jacket with air-inflatable air pockets.

U.S. Pat. No. 6,116,985 of Lambert describes a cushioned sports brassiere with a hard internal breast plate.

Also, U.S. Pat. No. 6,131,196 of Vallion discloses a protective pad for knees with layers of bubble cushioning material.

Among pneumatic air pumped brassieres include U.S. Pat. No. 2,516,129 of Leo, U.S. Pat. No. 2,741,769 of White, U.S. Pat. No. 2,764,759 of Gazello, U.S. Pat. No. 5,347,656 of Fabritz, U.S. Pat. Nos. 6,080,037 and 6,302,760 of Dai.

However, the prior art does not disclose a brassiere with one or more removable washable or disposable bubble wrap insert pads for size enhancement and sports impact resistance.

OBJECTS OF THE INVENTION

It is therefore an object of the present invention to provide a brassiere insert which has both size enhancement and impact resistant features.

Other objects which become apparent from the following description of the present invention.

SUMMARY OF THE INVENTION

The present invention uses a brassiere of conventional construction with minor modifications. In a preferred embodiment, the cup area is double-layered forming a pocket on each side for insertion of one or more inserts therein. The inner side edge of each cup is left open with a small patch of hook and loop closure material is added. In this way, padding material to enhance the breast profile can be easily added or removed between the layers.

In another embodiment, the insert or inserts are placed within the skin-facing side of a pocketless cup of a brassiere.

In this invention, the padding material is similar to air-filled plastic bubble sheets that are commonly used for packaging applications. One or more such layers of a variety of bubble heights can be used to easily adjust the desired degree of figure enhancement. Since the air is sequestered by the bubble construction, there is no tendency to shift.

Also, preferably vent holes are punched in the flat areas between the bubbles so as to provide needed ventilation.

The problem with the use of actual packaging grade padding material for cosmetic purposes is the noise emission such as a crinkling sound when the material is manipulated or compressed. This is a by-product of the polyethylene material used in construction; obviously this is not objectionable for packaging applications.

For this application of this invention, however, an elastomer such as polyurethane is used to construct the bubble material. Although more expensive to produce, it is still quite affordable for this application. This material change solves the sound emission problem and provides a more supple feel to the inserts.

Each pad may be a circular or similar shape for covering the entire breast, or may be a shape having a width greater than its height, so that the pad can be used adjacent to only the lower portion of the breast, for figure enhancement.

Another embodiment of the present invention modifies the outer layer of the cup area to provide improved impact protection, thus forming a sports bra of similar construction to the cosmetic version.

Preferably, this impact resistant woman's brassiere includes two fabric breast cups, each having pockets attached to a plurality of straps to secure the brassiere to a person's torso, with a plurality of shock absorbing removably insertable pads of high tensile strength polymer material, such as urethane, having shape memory along with a plurality of disbursed air-filled bladders.

A scattered plurality of vent holes reduces sweat accumulation and promotes evaporation of sweat.

Fasteners are attached to the fabric breast cups in order to anchor the pads within the pockets, wherein optionally a pair of underwires are secured onto the lower portion of the breast cup.

Moreover, two or more pads may be inserted into each breast cup to enhance protection and simulate a greater bust size. In addition, a convex centralized area of the pad may be is shaped to resemble a human nipple.

The brassiere of the present invention can be used to protect the breast from shock by inserting one or more air-bubble filled pads into the fabric brassiere to absorb shock and by adding extra pads for increased protection and an enhanced bust line.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
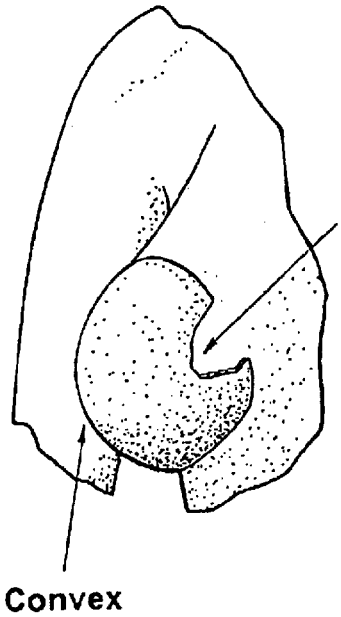
FIG. 1 (Prior Art)
FIG. 1 is a perspective view of a prior art silicone insert showing the molded shape with concave inner and convex outer surfaces.

FIG. 1 shows a prior art silicone insert that is often used for figure enhancement. It has an inner concave surface contoured to fit the breast of the user. The outer surface is convex and silicone gel is encased between the two elastomeric plastic surface films. This type of enhancement device is considered to provide the most acceptable result by many users. The silicone material simulates the natural feel of flesh by its compressibility, resistance to shifting, and supple conformability.

It is quite expensive however, and its level of enhancement is not adjustable. It is not vented, and its weight is considerable. A modest insert weighs 5 ounces (142 grams).

Figure 2:
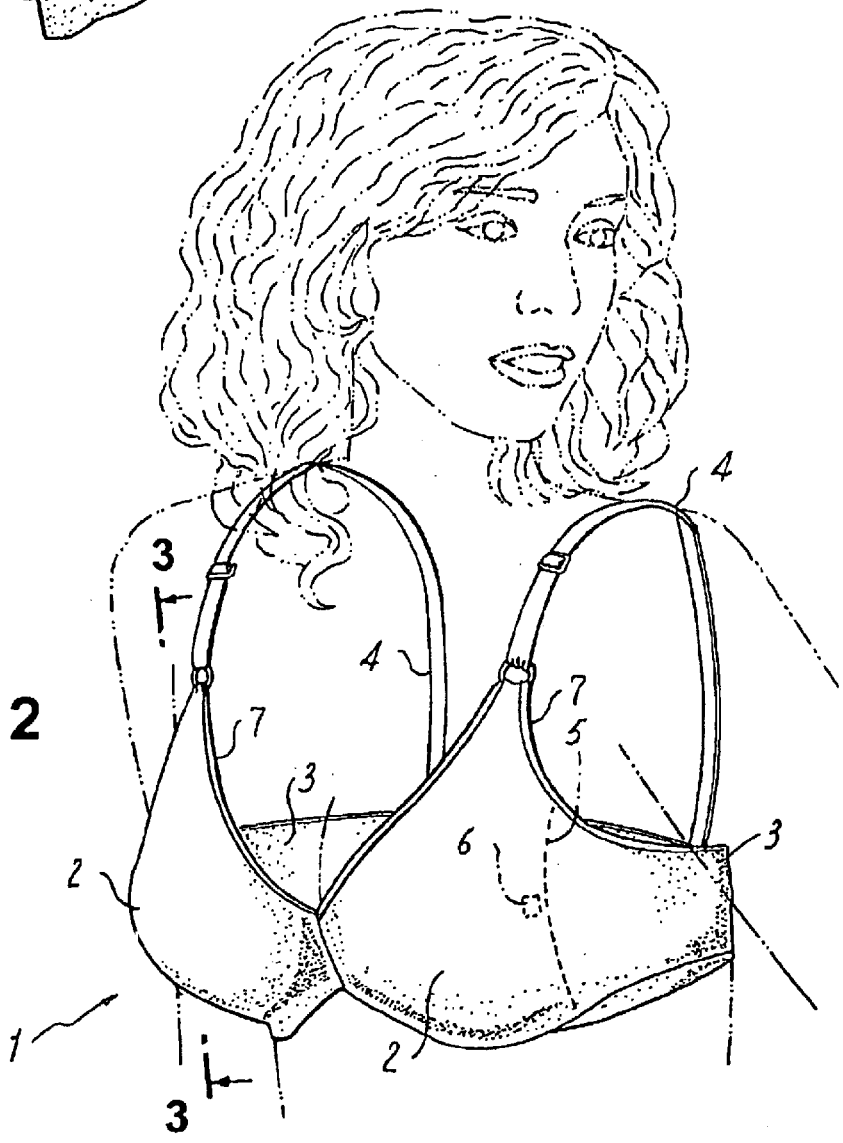
FIG. 2 is a perspective view of the one embodiment for an air-filled brassiere of this invention, shown with pockets.

FIG. 2 shows one embodiment for the air-filled brassiere 1 of this invention. It has the familiar side straps 3, top straps 4 and seams 7 to help form cup areas 2. Since the bra construction details of this invention are confined to cups 2, any kind of general brassiere type such as strapless varieties also can be modified as described.

In the view of FIG. 2, dashed line 5 shows the side opening of inner layer of cup 2 to permit insertion and removal of padding material. Fasteners, such as, hook and loop tabs 6, are used as a simple closure to retain the padding material.

Figure 2A:
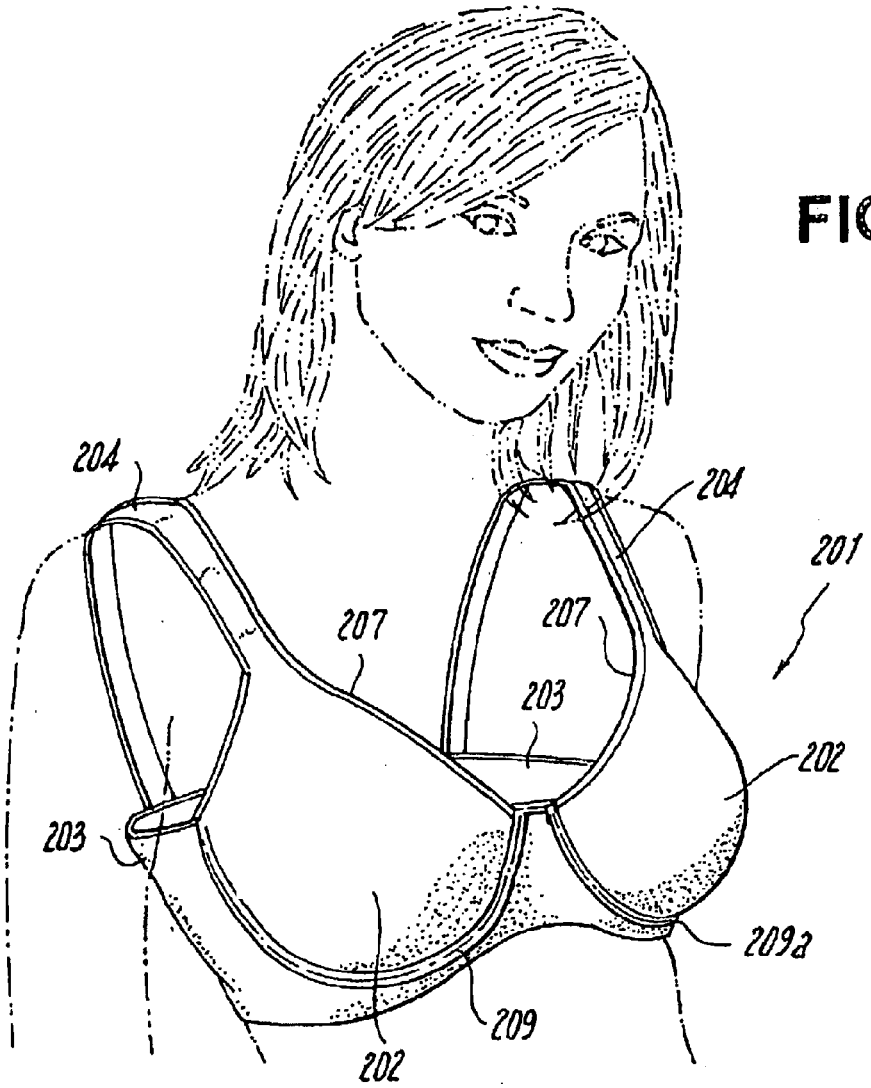
FIG. 2A is a perspective view of a further one embodiment for an air-filled brassiere of this invention, shown with pockets.

FIG. 2A shows another embodiment for the air-filled brassiere 201 of this invention. It also has the familiar side straps 203, top straps 204 and seams 207 to help form cup areas 202, however top straps 204 are removable. Support underwires 209 and 209*a* are also shown.

Figure 3:
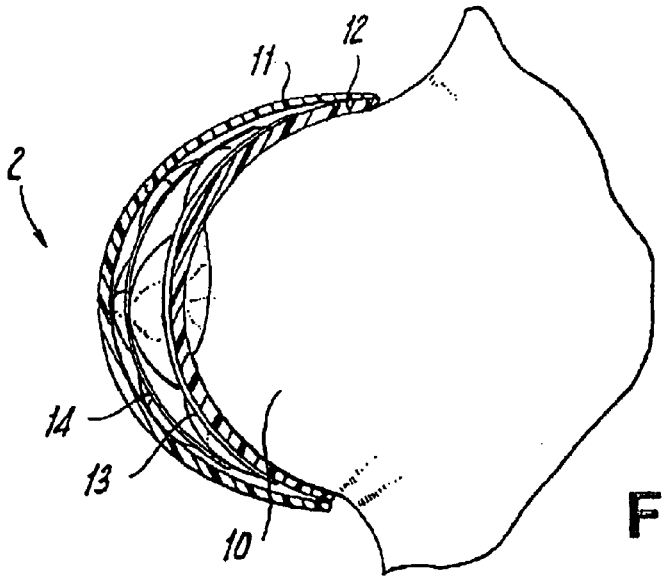
FIG. 3 is a side elevational view in crossection of the various layers of the cup area and their fit on a user, showing an example of two removably insertable pads within a cup of the brassiere as in FIG. 2, taken along lines 2—2 of FIG. 2.

FIG. 3 is a side crossectional view showing the fit of cup 2 of brassiere 1 over a breast 10 of the user. Inner layer 12 and outer layer 11 are preferably made of thick non-woven lightweight material such as a polyester nylon blend. Appropriate material such as cotton or polyester is used as desired to line this padded material which has a small amount of shape rigidity. Two layer insert pads of air-filled bubble material are shown pushing apart layers 11 and 12; these are bottom layer insert 13 and top layer insert 14.

Conventional air-filled bubble packaging material is generally made of polyethylene film. This material is flexible, but it is not an elastomer as can be witnessed by the "tension relieving" practice of "popping bubbles". At a certain level of internal pressure, the bubble just ruptures. Since the crinkling sounds produced by the manipulation of such packaging material is objectionable for this cosmetic application, a physical analog of it fabricated from a thermoplastic elastomer is used instead in the present invention.

One technique for manufacture vacuum forms the bubble pattern on one layer and then seals a flat layer to it by radio frequency welding. A thermoplastic grade of polyurethane such as MP1880 from Stevens Urethane of Holyoke, Mass. is one material that can be used. This forms bubbles filled with air at ambient atmospheric pressure. They easily conform to the shape between layers 11 and 12 by virtue of the enclosed air compression as well as the elastomeric film used. This insert material can be washed and used several times, although eventually air loss due to slow permeability from repeated uses will make it ineffective. Then new pads should be used.

Figure 3A:
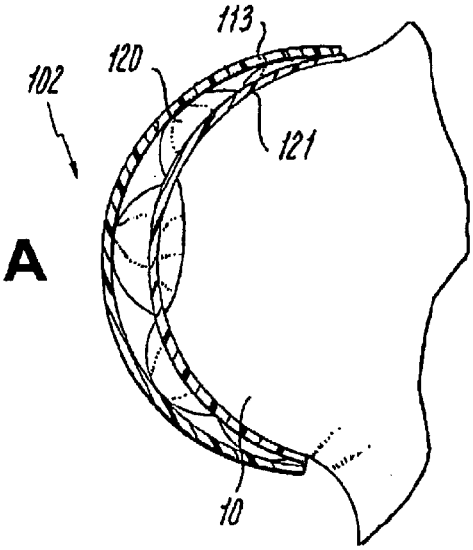
FIG. 3A is a side elevational view in crossectional of an alternate embodiment for a brassiere holding a bra insert in the skin-facing side of a cup without pockets, wherein the bra insert includes one or more air bubble cells.

FIG. 3A is a side crossectional view of an alternate embodiment for a bra insert 113 having one or more air bubble cells 120. Unlike bra layer insert pads 13 or 14 of FIG. 3, which are shown within a pocket between layers 11 and 12 of bra showing the fit of cup 2 over a breast 10 of the user, bra insert 113 is worn within a bra cup 2 of a pocketless brassiere in the inner portion adjacent to the skin of the user. Inner layer 121 of bra insert 113 is therefore made of a suitable soft material, such as cotton or polyester.

Figure 3B:
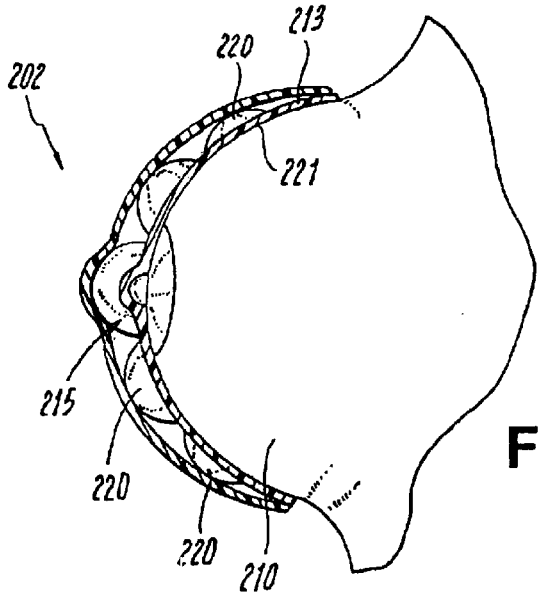
FIGS. 3B and 3C are side elevational views in crossection of further alternate embodiments, each for a brassiere having a pad insert with a convex centralized nipple area.
Figure 3C:
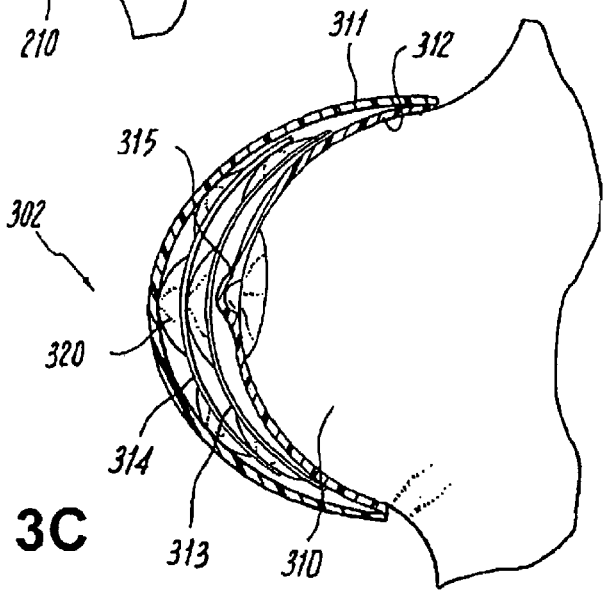

FIG. 3B is a side crossectional view of a further alternate embodiment for a bra insert 213 having one or more air bubble cells 220 and convex centralized area 215. Bra insert 213 is worn within a bra cup 202 of a brassiere in the inner portion adjacent to the skin of the user. Inner layer 221 of bra insert 213 is therefore also made of a suitable soft material, such as cotton or polyester. FIG. 3C shows a further alternate embodiment similar to the embodiment of FIG. 3, but where cup 302 for breast 310 has convex centralized nipple area 315 being provided within inner cup layer 312. Convex centralized nipple area 315 extends into the area between outer cup layer 311 having one or more insert pads 313 and/or 314 having at least one air bubble 320 therebetween.

Figure 4:
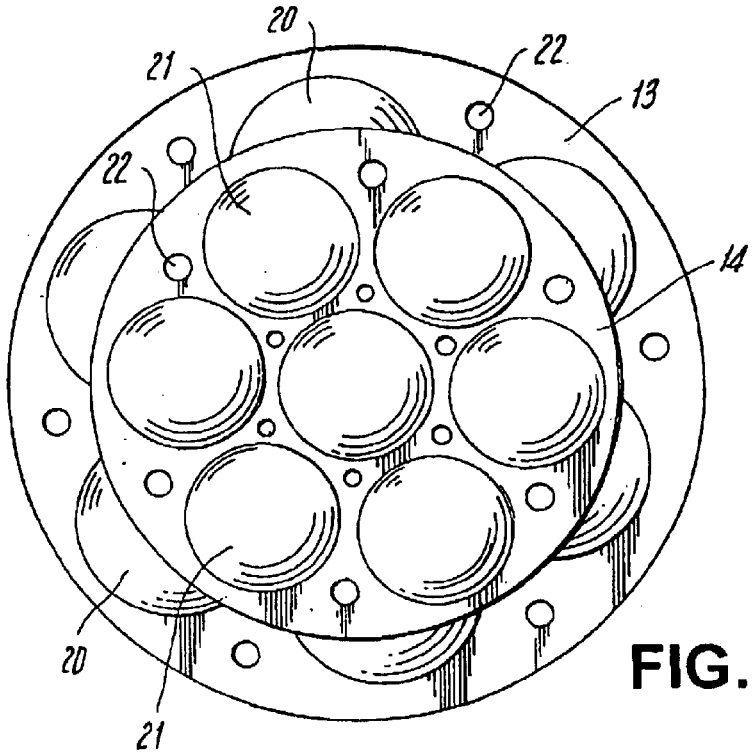
FIG. 4 is a top plan view of two layer pads of air bubble padding material in an overlaying relationship.

FIG. 4 shows optional use of two discrete layer pads 13 and 14 of air-filled bubble material on top of each other. Top layer 14 has smaller hemispheric bubbles 21 while larger bottom layer 13 has bubbles 20 of a larger diameter and height. The spaces around the bubbles 20 or 21 are preferably punched with vent holes 22. With the two pads as shown, three levels of breast profile enhancement are supported. Pad 14 alone provides least enhancement. Pad 13 alone provides a medium level, while the use of both pads stacked as shown provides even more separation between layers 11 and 12.

Since pads 13 and 14 are discrete and separate, the user can choose to employ one or more layers of bra insert pads 13, 14 within a bra cup 2.

The cushioning capability of air-filled bubble pads along with their light weight and venting feature make them attractive for a sports bra. The air-filled brassiere of this invention can be modified into a sports bra embodiment, to provide protection and impact resistance to the breast from projectiles in sporting events, such as hard balls in a women's lacrosse match or soccer balls in a women's soccer game.

Figure 5:
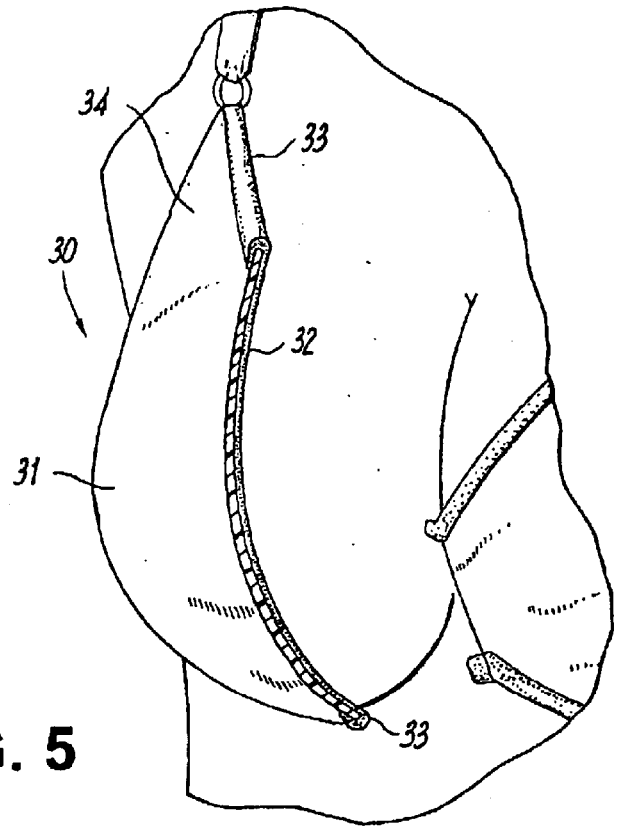
FIG. 5 is a side elevational crossectional view of a further embodiment for an impact resistant outer cup layer for a sports bra application.

FIG. 5 shows the outer layer 30 of cup 2 for this usage. This is a substitute for layer 11 in FIG. 3. Layer 30 includes a rigid or semi-rigid outer shell 31 of high impact resistance. It is lined with a thin layer 32 of closed cell foam material (such as polyurethane) that has increased thickness at the edges 33 and is continued to the outer surface for full edge protection. This is necessary because the air bubble pads do not offer sufficient edge protection.

Shell 31 can be molded of polycarbonate or acrylonitrile butadiene styrene (ABS) for high impact resistance if a hard surface is acceptable for the sport. Also, sport specific bras can specify no coating or a high friction coating on outer surface 34 of shell 31.

For example, a shiny low friction surface for sports such as hockey or basketball might offer some injury avoidance, while a bra for use in soccer where the surface of shell 31 is used for ball control would have a non-slip surface such as is often applied to tool handles or writing instruments. For the rough use of sports, the noise factor of standard packaging air bubble material is of little importance.

Also, for hygienic reasons and insurance of peak impact cushioning, a new insert pad should be used every time. For one-time disposable use by non-professional sportswomen, cost is an important factor. This leads to the acceptable use of a heavy duty commercial air bubble material such as AirCap brand type SD-480 from Sealed Air Corporation of Saddle Brook, N.J. Of course, vent holes can be punched between the bubbles. This is manufactured in large quantities for heavy duty packaging of military cargo. It has high burst strength, and very low air loss due to the use of a nylon air barrier layer used in its fabrication. It is made by a highly automated co-extrusion process of a multilayer polyethylene material.

Figure 6:
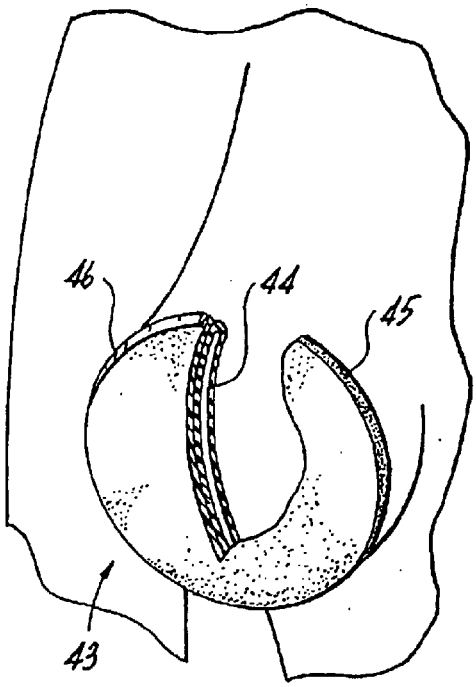
FIG. 6 is a front perspective view of an alternate embodiment for a single air cell bra insert for the bottom half of a brassiere cup.

Other configurations may be used. For example, FIG. 6 is a front perspective view of an alternate embodiment for a smaller single air cell bra insert 43 with a single air bubble cell 44 therein for use adjacent to the lower half of the breast. Therefore, the insert 43 of FIG. 6 is shown with a wider width than its height, for mainly supporting the lower portion of the breast from below, for figure enhancement. As also shown in FIG. 6, an adhesive strip 45 with a lift-off cover strip 46 can be used to attach insert 43 inside of either a pocket of a cup of a bra, or to the inside skin facing surface of a bra cup.

Figure 6A:
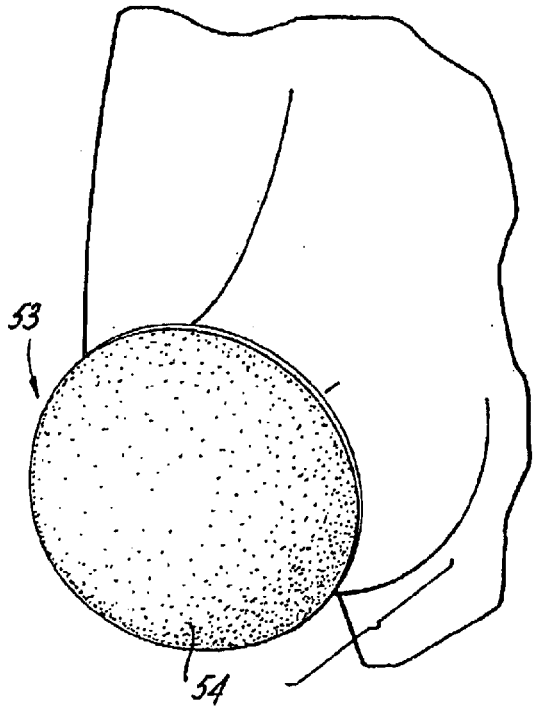
FIG. 6A is a front perspective view of a further alternate embodiment for a single air cell bra insert for an entire brassiere cup; and, FIG. 7 is a front perspective view of a further alternate embodiment for a multi-cell bra insert for the bottom half of a cup of a brassiere.

However, it is also contemplated that a circular disc-shaped bra insert 53 with single air bubble cell 54, as shown in FIG. 6A, can also be used.

Figure 7:
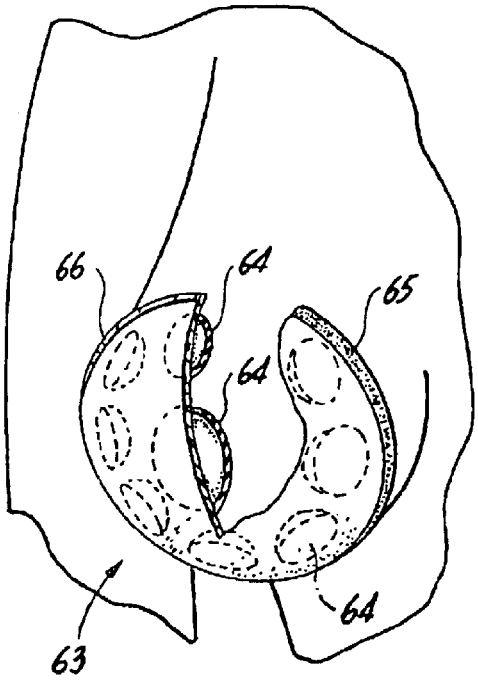

FIG. 7 is a front perspective view of a further alternate embodiment for a multi-cell bra insert 63 having a wider width than its height. In FIG. 7, however, bra insert 63 has multiple bubble type cells 64. Moreover, an adhesive strip 65 with a lift-off cover strip 66 can be used to attach insert 63 inside of either a pocket of a cup of a bra, or to the inside skin facing surface of a bra cup. Similar adhesive strips can be used with bra insert pads 13 and 14 shown in FIGS. 3 and 4.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

I claim:

1. An impact resistant woman's brassiere comprising:

two fabric breast cups each having a respective pocket attached to a plurality of straps to secure the brassiere to a person's torso;

at least one shock absorbing removably insertable pad comprising of high tensile strength polymer material having shape memory along with a plurality of disbursed air-filled bladders, said at least one shock absorbing removably insertable pad further including a scattered plurality of vent holes.

2. The impact resistant woman's brassiere as in claim 1 further comprising:

at least one fastener attached to each of said fabric breast cups in order to anchor each said removably insertable pad within each said respective pocket.

3. The impact resistant woman's brassiere, as in claim 1, wherein a pair of underwires are secured onto the lower portion of the breast cup.

4. The impact resistant woman's brassiere, as in claim 1, wherein the material used for each of said pads is urethane.

5. The impact resistant woman's brassiere, as in claim 3, wherein two or more pads are removably insertable into each breast cup to enhance protection and simulate a greater bust size.

6. The impact resistant woman's brassiere, as in claim 1, wherein a convex centralized area of the pad is shaped to resemble a human nipple.

7. The impact resistant woman's brassiere, as in claim 1, wherein said straps are detachable.

8. The impact resistant woman's brassiere, as in claim 1, further comprising a further protective outer layer of at least one of a rigid and a semi-rigid outer shell of high impact resistance, said outer shell being lined with a layer of closed cell foam material with an increased thickness at respective edges thereof.

9. The impact resistant woman's brassiere, as in claim 8, wherein said outer shell is molded of polycarbonate.

10. The impact resistant woman's brassiere, as in claim 8, wherein said outer shell is molded of acrylonitrile butadiene styrene.

11. The impact resistant woman's brassiere, as in claim 1, wherein each said pad is washable.

12. The impact resistant woman's brassiere, as in claim 1, wherein each said pad is disposable.

13. The impact resistant woman's brassiere, as in claim 1, wherein each said pad is has a circular shape.

14. The impact resistant woman's brassiere, as in claim 1, wherein each said pad has a width greater than its height.

15. The impact resistant woman's brassiere, as in claim 1, wherein each said pad includes an adhesive strip covered by a lift-off strip, said pad attachable to an inside of a respective cup of said brassiere.

16. An impact resistant woman's brassiere comprising:

two fabric breast cups attached to a plurality of straps to secure the brassiere to a person's torso;

at least one shock absorbing removably insertable pad comprising of high tensile strength polymer material having shape memory along with a plurality of disbursed air-filled bladders.

17. The impact resistant woman's brassiere as in claim 16 further comprising:

at least one fastener attached to each of said fabric breast cups in order to anchor each said removably insertable pad within each said respective pocket.

18. The impact resistant woman's brassiere, as in claim 16, wherein a pair of underwires are secured onto the lower portion of the breast cup.

19. The impact resistant woman's brassiere, as in claim 16, wherein the material used for each of said pads is urethane.

20. The impact resistant woman's brassiere, as in claim 16, wherein two or more pads are removably insertable into each breast cup to enhance protection and simulate a greater bust size.

21. The impact resistant woman's brassiere, as in claim 16, wherein a convex centralized area of the pad is shaped to resemble a human nipple.

22. The impact resistant woman's brassiere, as in claim 16, wherein said straps are detachable.

23. The impact resistant woman's brassiere, as in claim 16, further comprising a further protective outer layer of at least one of a rigid and a semi-rigid outer shell of high impact resistance, said outer shell being lined with a layer of closed cell foam material with an increased thickness at respective edges thereof.

24. The impact resistant woman's brassiere, as in claim 23, wherein said outer shell is molded of polycarbonate.

25. The impact resistant woman's brassiere, as in claim 23, wherein said outer shell is molded of acrylonitrile butadiene styrene.

26. The impact resistant woman's brassiere, as in claim 16, wherein each said pad is washable.

27. The impact resistant woman's brassiere, as in claim 16, wherein each said pad is disposable.

28. The impact resistant woman's brassiere, as in claim 16, wherein each said pad is has a circular shape.

29. The impact resistant woman's brassiere, as in claim 16, wherein each said pad has a width greater than its height.

30. The impact resistant woman's brassiere, as in claim 16, wherein each said pad includes an adhesive strip covered by a lift-off strip, said pad attachable to an inside of a respective cup of said brassiere.

31. A method of protecting a human breast from shock comprising:

inserting removable pads having at least one layer of a plurality of discrete air-filled air bladders and vent holes into a fabric brassiere to absorb shock; and adding extra pads for increased protection and an enhanced bust line.

* * * * *